US006634473B1

(12) United States Patent
Wagner

(10) Patent No.: US 6,634,473 B1
(45) Date of Patent: Oct. 21, 2003

(54) COSMETIC TOTE BAG

(76) Inventor: Tracey A. Wagner, Rural Route 4, Georgetown, Ontario (CA), L7G 4S7

( * ) Notice: Subject to any disclaimer, the term of this patent is extended or adjusted under 35 U.S.C. 154(b) by 0 days.

(21) Appl. No.: 10/084,083

(22) Filed: Feb. 27, 2002

(51) Int. Cl.[7] ..... A45C 3/00
(52) U.S. Cl. ..... 190/110
(58) Field of Search ..... 190/108, 109, 190/110; 150/111, 113; 383/38, 39

(56) References Cited

U.S. PATENT DOCUMENTS 2,428,906 A * 10/1947 Cannella ..... 150/108
3,086,572 A * 4/1963 Lubin ..... 150/107
4,263,951 A * 4/1981 Siegel ..... 150/35
4,773,535 A * 9/1988 Cook ..... 206/373
5,815,843 A * 10/1998 Brillhart, III et al. ..... 150/111
6,244,400 B1 * 6/2001 Bowers ..... 190/110

* cited by examiner

*Primary Examiner*—Tri M. Mai

(57) ABSTRACT

A cosmetic tote bag for providing a more sanitary manner of storing, organizing, and transporting cosmetics. The cosmetic tote bag includes a foldable bag member having a first panel member and a second panel member being hingedly attached to the first panel member, and also having handle members being securely attached to the first and second panel members; and further includes pouch members being removably and fastenably attached to the foldable bag member; and also includes fastening members for securely fastening the pouch members to the foldable bag member.

6 Claims, 2 Drawing Sheets

COSMETIC TOTE BAG

BACKGROUND OF THE INVENTION

1. Field of the Invention

The present invention relates to cosmetic carrying bags and more particularly pertains to a new cosmetic tote bag for providing a more sanitary manner of storing, organizing, and transporting cosmetics.

2. Description of the Prior Art

The use of cosmetic carrying bags is known in the prior art. More specifically, cosmetic carrying bags heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 6,000,509; U.S. Pat. No. 6,152,202; U.S. Pat. No. 4,754,790; U.S. Pat. No. 6,003,573; U.S. Pat. No. 4,782,874; U.S. Pat. No. 4,022,261; U.S. Pat. No. 754,207; and U.S. Pat. No. Des. 423,771.

While these devices fulfill their respective, particular objectives and requirements, the aforementioned patents do not disclose a new cosmetic tote bag. The inventive device includes a foldable bag member having a first panel member and a second panel member being hingedly attached to the first panel member, and also having handle members being securely attached to the first and second panel members; and further includes pouch members being removably and fastenably attached to the foldable bag member; and also includes fastening members for securely fastening the pouch members to the foldable bag member; and has fastening members to allow the user to easily attach and remove the pouch members from the foldable bag member to gain access to the items in each of the pouch members when needed, features not described nor suggested by any of the prior art.

In these respects, the cosmetic tote bag according to the present invention substantially departs from the conventional concepts and designs of the prior art, and in so doing provides an apparatus primarily developed for the purpose of providing a more sanitary manner of storing, organizing, and transporting cosmetics.

SUMMARY OF THE INVENTION

The general purpose of the present invention, which will be described subsequently in greater detail, is to provide a new cosmetic tote bag apparatus and method which has many of the advantages of the cosmetic carrying bags mentioned heretofore and many novel features that result in a new cosmetic tote bag which is not anticipated, rendered obvious, suggested, or even implied by any of the prior art cosmetic carrying bags, either alone or in any combination thereof.

There has thus been outlined, rather broadly, the more important features of the cosmetic tote bag in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new cosmetic tote bag apparatus and method which has many of the advantages of the cosmetic carrying bags mentioned heretofore and many novel features that result in a new cosmetic tote bag which is not anticipated, rendered obvious, suggested, or even implied by any of the prior art cosmetic carrying bags, either alone or in any combination thereof.

Still another object of the present invention is to provide a new cosmetic tote bag for providing a more sanitary manner of storing, organizing, and transporting cosmetics.

Still yet another object of the present invention is to provide a new cosmetic tote bag that is readily and easily accessible for the user.

Even still another object of the present invention is to provide a new cosmetic tote bag that allows the user to throw away the old pouch members and use new and clean pouch members periodically.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
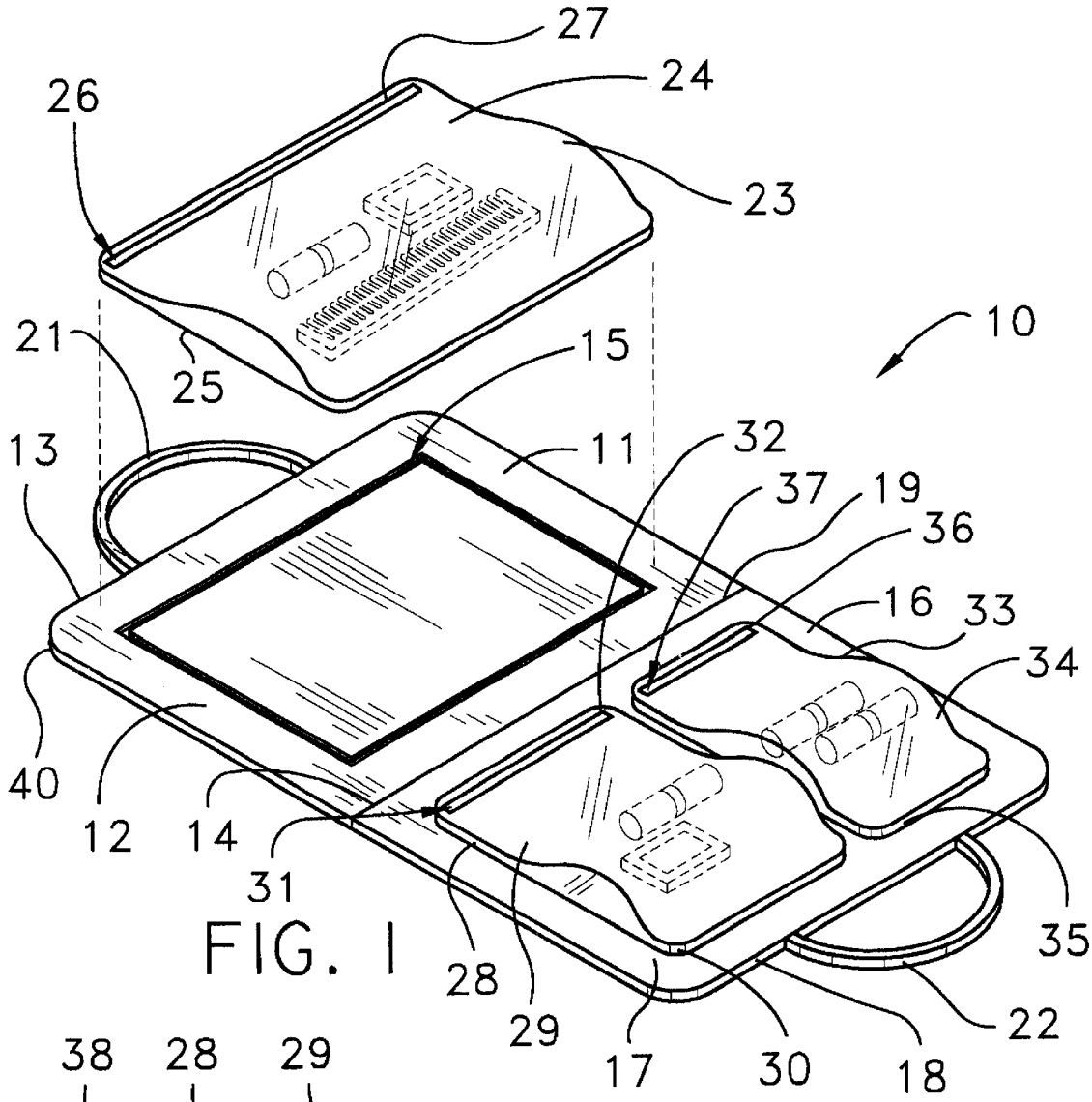
FIG. 1 is a partial exploded perspective view of a new cosmetic tote bag according to the present invention and shown in use.
Figure 3:
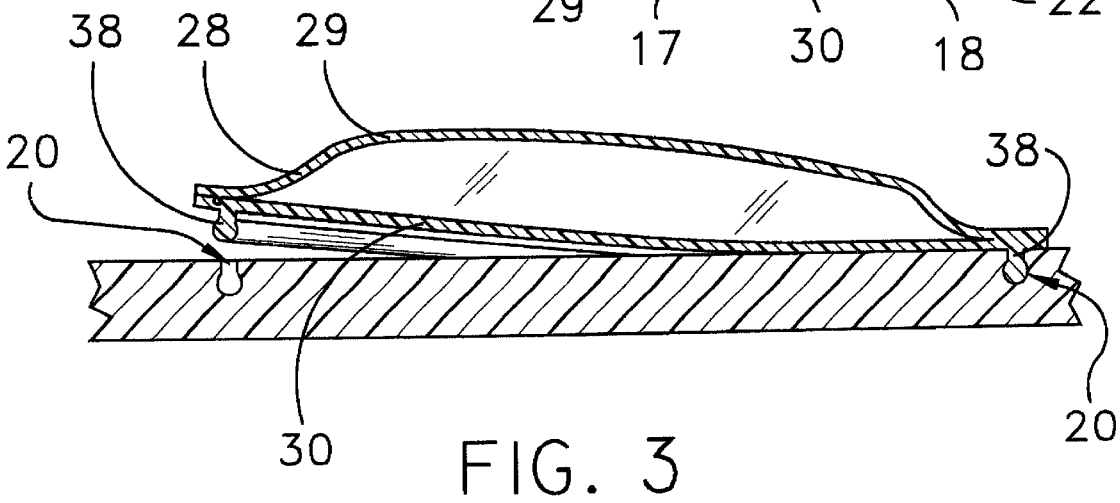
FIG. 3 is a cross-sectional view of the present invention.
Figure 4:
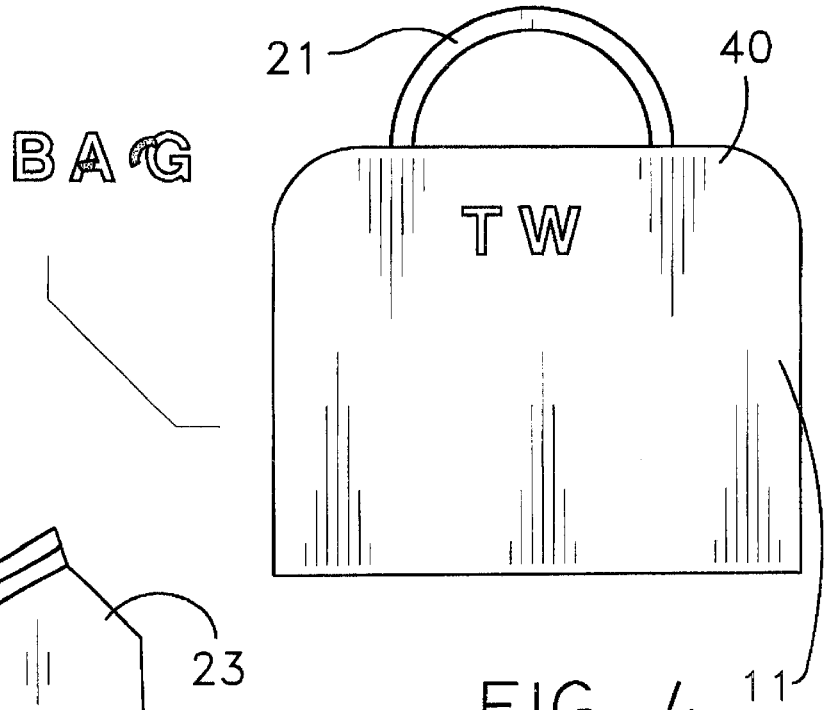
FIG. 4 is a front elevational view of the present invention.
Figure 2:
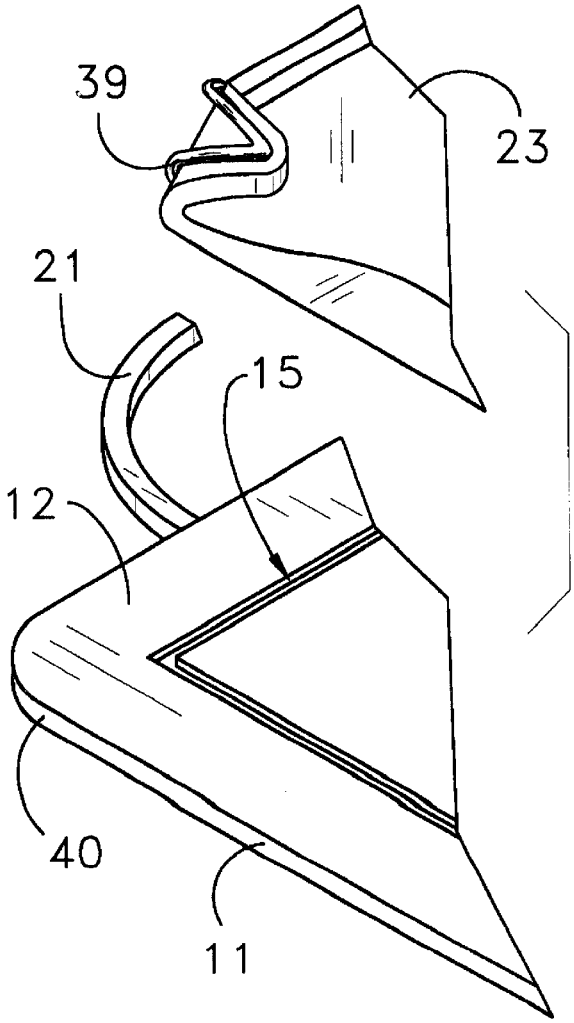
FIG. 2 is a partial perspective view of the present invention.

With reference now to the drawings, and in particular to FIGS. 1 through 4 thereof, a new cosmetic tote bag embodying the principles and concepts of the present invention and generally designated by the reference numeral 10 will be described.

As best illustrated in FIGS. 1 through 4, the cosmetic tote bag 10 generally comprises a foldable bag member 40 having a first panel member 11 and a second panel member 16 being hingedly and conventionally attached to the first panel member 11, and also having handle members 21,22 being securely and conventionally attached to the first and second panel members 11,16. Each of the first and second panel members 11,16 has an inner side 12,17, and has a top end 13,18 and a bottom end 14,19. The bottom ends 14,19 of the first and second panel members 11,16 are hingedly and conventionally attached to one another. The first panel member 11 has a continuous groove 15 being disposed therein, and the second panel member 16 has a plurality of bulbous slots 20 being disposed therein. The continuous groove 15 is squared. The handle members 21,22 are securely and conventionally attached and sewn to the top ends 13,18 of the first and second panel members 11,16.

Pouch members 23,28,33 are removably and fastenably attached to the foldable bag member 40. Each of the pouch members 23,28,33 has front and back walls 24,25,29,30,34,35, a storage compartment being conventionally disposed between the front and back walls 24,25,29,30,34,35, an opening 26,31,36 into the storage compartment, and a closure 27,32,37 for closing the opening 26,31,36 to prevent items stored in the storage compartment from falling out.

Fastening members 38,39 for securely fastening the pouch members 23,28,33 to the foldable bag member 40 include bulbous tab members 38 being securely and conventionally attached near corners of a respective back wall 30,35 of one or more of the pouch members 28,33 and being removably and securely received in the bulbous slots 20 of the second panel members 16 to securely and removably attach the one or more pouch members 28,33 to the foldable bag member 40. The fastening members 38,39 also include a continuous rib member 39 being securely and conventionally attached to a respective back wall 25 of another one or more of the pouch members 23 and being securely and removably received in the continuous groove 15 to securely and removably hold the another one or more of the pouch members 23 to the foldable bag member 40. The continuous rib member 39 is securely and conventionally attached along a perimeter of a respective back wall 25 of another one or more of the pouch members 23.

In use, the user unfolds the foldable bag member 40 and opens the closure 27,32,37 to the selected pouch members 23,28,33 to gain access to the items contained therein. Once finished, the user restores the items and secures the closure 27,32,37. The user can also readily dispose of the pouch members 23,28,33 by simply removing them from the foldable bag member 40, and fasten new and clean pouch members 23,28,33 to the foldable bag member 40.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the cosmetic tote bag. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A cosmetic tote bag comprising:

a foldable bag member having a first panel member and a second panel member being hingedly attached to said first panel member, and also having handle members being securely attached to said first and second panel members, each of said first and second panel members has an inner side, and has a top end and a bottom end, said bottom ends of said first and second panel members being hingedly attached to one another, said first panel member having continuous loop groove disposed therein, and said second panel member having a plurality of bulbous slots disposed therein;

pouch members being removably and fastenably attached to said foldable bag member; and fastening members for securely fastening said pouch members to said foldable bag member.

2. A cosmetic tote bag as described in claim 1, wherein said handle members are securely attached to said top ends of said first and second panel members.

3. A cosmetic tote bag as described in claim 1, wherein each of said pouch members has front and back walls, a storage compartment disposed between said front and back walls, an opening into said storage compartment, and a closure for closing said opening to prevent items stored in said storage compartment from falling out.

4. A cosmetic tote bag as described in claim 3, wherein said fastening members include bulbous tab members being securely attached near corners of a respective said back wall of one or more of said pouch members and being removably and securely received in said bulbous slots of said second panel members to securely and removably attach said one or more of said pouch members to said foldable bag member.

5. A cosmetic tote bag as described in claim 4, wherein said fastening members also include a continuous rib member being securely attached to said back wall of a selected said pouch member and being securely and removably received in said continuous groove to securely and removably hold said pouch member to said foldable bag member.

6. A cosmetic tote bag as described in claim 5, wherein said continuous rib member is securely attached along a perimeter of said back wall of said pouch member.

* * * * *